US010065835B2

(12) United States Patent
Walker

(10) Patent No.: US 10,065,835 B2
(45) Date of Patent: Sep. 4, 2018

(54) CAR DOOR-SHAFT DOOR COUPLING

(71) Applicant: Inventio AG, Hergiswil (CH)

(72) Inventor: Willy Walker, Buchrain (CH)

(73) Assignee: INVENTIO AG, Hergiswil (CH)

( * ) Notice: Subject to any disclaimer, the term of this patent is extended or adjusted under 35 U.S.C. 154(b) by 1109 days.

(21) Appl. No.: 14/367,264

(22) PCT Filed: Nov. 29, 2012

(86) PCT No.: PCT/EP2012/073991
§ 371 (c)(1),
(2) Date: Jun. 20, 2014

(87) PCT Pub. No.: WO2013/092164
PCT Pub. Date: Jun. 27, 2013

(65) Prior Publication Data

US 2015/0013231 A1 Jan. 15, 2015

(30) Foreign Application Priority Data

Dec. 21, 2011 (EP) ..... 11194732

(51) Int. Cl.
*B66B 13/12* (2006.01)
*B66B 13/06* (2006.01)

(52) U.S. Cl.
CPC ..... *B66B 13/12* (2013.01); *B66B 13/06* (2013.01); *Y10T 74/18944* (2015.01)

(58) Field of Classification Search
CPC ..... B66B 13/12
See application file for complete search history.

(56) References Cited

U.S. PATENT DOCUMENTS

| | | | | |
|---|---|---|---|---|
| 5,636,715 A | 6/1997 | Hayashi et al. | | |
| 6,070,700 A * | 6/2000 | Nagel | B66B 13/12 | 187/319 |
| 2012/0305336 A1 * | 12/2012 | Walker | B66B 13/12 | 187/330 |

FOREIGN PATENT DOCUMENTS

| | | | | |
|---|---|---|---|---|
| CH | 523199 A * | 5/1972 | B66B 13/12 | |
| EP | 0679602 A1 | 11/1995 | | |
| EP | 0829446 A1 | 3/1998 | | |
| FR | 2421134 A1 * | 10/1979 | B66B 13/12 | |
| JP | 08048480 A * | 2/1996 | B66B 13/12 | |
| JP | 2005170681 A * | 6/2005 | B66B 13/12 | |
| JP | 4574803 B2 | 11/2010 | | |
| WO | 2011072891 A1 | 6/2011 | | |

* cited by examiner

*Primary Examiner* — Michael A Riegelman
(74) *Attorney, Agent, or Firm* — William J. Clemens; Shumaker, Loop & Kendrick, LLP

(57) ABSTRACT

A car door-shaft door coupling for arrangement on a door wing with a door leaf plane includes a pivoting lever, which is rotatably mounted on a rotational axis on a support element, and a moveable element, which is coupled to the pivoting lever in such a manner that a movement of the moveable element carried out parallel to the door leaf plane causes the pivoting lever to perform a rotational movement for coupling a car door to a shaft door and change the distance between the lever and the door leaf plane by horizontal movement.

16 Claims, 8 Drawing Sheets

Section A - A

CAR DOOR-SHAFT DOOR COUPLING

FIELD

The invention relates to a car door/shaft door coupling usable for coupling a car door with a shaft door in a door system of an elevator installation.

BACKGROUND

Such car door/shaft door couplings are used in order to couple a car door leaf, which is actuated by a door drive, with a shaft door leaf. An elevator car comprises a door drive and a car door. The car door has at least one car door leaf and a car door threshold. In addition, individual shaft doors each with at least one respective shaft door leaf and shaft door threshold can be arranged along an elevator shaft in which the elevator car can be vertically moved.

The shaft doors are usually closed. In the case of corresponding positioning at a predefined stopping position of the elevator car in the elevator shaft an interior space of the elevator car can be entered via one of the shaft doors and the car door. This requires synchronous opening or closing of the car door leaf and shaft door leaf at this stopping position, which can be ensured by the car door/shaft door coupling. The car door/shaft door coupling can be fixed to a car door leaf.

A coupling device which can be actuated by the car door/shaft door coupling for the purpose of a coupling is accordingly arranged at the shaft door leaf at the predefined stopping position. In that case, an area at each shaft door in which the car door/shaft door coupling can engage in the coupling device is predefined and very limited. It is characterized by a spacing, which is projected along the travel path of the elevator car, of the elevator car door threshold from the shaft door threshold in the form of a gap. When dynamic tolerances occur such as, for example, car movements or static tolerances such as, for example, building displacements it can happen in the case of travel of the elevator car that the car door/shaft door coupling can collide with the shaft door threshold or the coupling device.

EP 0 829 446 shows a pivotably mounted car door/shaft door coupling. The car door/shaft door coupling comprises two pivot levers and two entrainer cams. The entrainer cams are so mounted on the pivot levers parallelly to one another that when rotational movement of the pivot lever occurs they maintain their orientation and change their spacing from one another. The change of this spacing serves the purpose of coupling a car door leaf with a shaft door leaf. The rotational movement of the pivot lever is achieved by means of a coupling of the car door/shaft door coupling with a door drive. The pivot levers are rotatably mounted on a base plate, which can be pivoted out of the afore-mentioned gap by means of an additional actuator. This is achieved in that the car door/shaft door coupling is retracted from the gap during the elevator travel and correspondingly prevents, in the case of building displacements or car movements, the car door/shaft door coupling from being able to collide with the shaft door threshold or the coupling device. A disadvantage of such a car door/shaft door coupling is that it is of complicated construction.

SUMMARY

It is therefore the object of the present invention to create a car door/shaft door coupling having a simplified construction.

The object is fulfilled by a car door/shaft door coupling which is provided for arrangement at a door leaf, comprising a pivot lever, which is mounted on a support element to be rotatable at an axis of rotation, and a movable element, which is so coupled with the pivot lever that a movement of the movable element executed parallelly to a door leaf plane has the effect that the pivot lever executes a rotational movement for coupling of a car door with a shaft door and at the same time changes its spacing from the door leaf plane by means of a horizontal movement. The object is also fulfilled by a door system of an elevator installation with a car door/shaft door coupling of that kind.

The invention is based on the recognition that the gap, which is characterized by a spacing—which is projected along the travel path of the elevator car—of the car door threshold from the shaft door threshold can be very tightly dimensioned due to regulations. In addition, the width of the gap during operation of the elevator car does not remain stable. This effect can be amplified by an elevator shaft which is higher and by an elevator car moved more rapidly in this elevator shaft. A car door/shaft door coupling, which is currently provided for that purpose and the coupling components of which can be retracted from this gap during elevator travel, has a complicated construction and is unnecessarily expensive due to actuation by two different drive means.

In order to minimize these outlays it was sought to utilize the movement of an single drive means not only for the movement of the components of the car door/shaft door coupling in the gap, but also for the coupling movement thereof. This is achieved in that the movement of a single drive means causes on the one hand, by the connection thereof with the pivot lever, a rotational movement of the pivot lever and on the other hand at the same time a longitudinal movement of the pivot lever along its axis of rotation. The movement of the sole drive means thus ensures that the car door/shaft door coupling is brought into position in the gap and that the coupling movement of the pivot lever belonging to the car door/shaft door coupling takes place. There is thus also the possibility of separating the operation of the car door/shaft door coupling from a door drive used for displacing the door leaf. The simultaneous execution of the longitudinal movement and rotational movement of the pivot lever enables fastest possible coupling of a car door with a shaft door.

In a development of the car door/shaft door coupling the car door/shaft door coupling has a first slide surface and a second slide surface, which are so inclined relative to the door leaf plane that in the case of movement of the movable element executed parallelly to the door leaf plane the first slide surface executes on the second slide surface a sliding movement which produces the rotational movement and the horizontal movement of the pivot lever. The movement of the movable element can be transferred in this way to the pivot lever.

In a development of the car door/shaft door coupling the first slide surface is constructed to be complementary with second slide surface. The guidance of the sliding movement can be improved in that way and the car door/shaft door coupling executed to be more stable.

In a development of the car door/shaft door coupling an entrainer element and preferably a second entrainer element parallel to and at a spacing from the entrainer element are mounted on the pivot lever, wherein the at least one entrainer element is mounted on the pivot lever at a respective entrainer axis parallel to and spaced from the axis of the rotation. The rotational movement of the pivot lever in that way leads to a possible spreading of the entrainer elements, in which case at the same time the orientation of the entrainer elements can be maintained. In that way, different geometries of an entrainer parallelogram can be realized and the device can be adapted in situ to specifics of the doors.

In a development of the car door/shaft door coupling a second pivot lever, at which the entrainer element is rotatably mounted in such a way that the entrainer element maintains its orientation at all times, is rotatably mounted on the support element.

In a development of the car door/shaft door coupling the movable element is coupled with the pivot lever at a mounting axis parallel and spaced from the axis of rotation. A possibility is thus given of converting the longitudinal movement of the element into a rotational movement of the pivot lever.

In a first variant of embodiment of the car door/shaft door coupling the car door/shaft door coupling can comprise a guide device at which the support element is guided perpendicularly to the door leaf plane, wherein the guide device is provided for the purpose of being fastened to a door leaf. In this variant of embodiment is possible to form the slide surfaces at the support element on the one hand and at the movable element on the other hand to be increased in size and thus to reduce material wear. In addition, the pivot lever can have a slot and the movable lever a pin, wherein the pin engages in the slot. In that way the movable element can be connected with the rotatable pivot lever in different forms of embodiment so that the movement can be transmitted.

In a second variant of embodiment of the car door/shaft door coupling the support element can be provided so as to be part of a door leaf or to be fastened to the door leaf. The door leaf can include parts of the car door/shaft door coupling, in which case material can be saved. It is also possible to reinforce the door leaf in the region of the car door/shaft door coupling. The support element can in that case have the first slide surface and the pivot lever can have the second slide surface in the form of threaded surfaces. The pivot lever can be connected with the movable element by means of a bearing. In that way the movement of the movable element can be transmitted to the rotatable pivot lever.

In a development of the door system of the elevator installation the door system comprises a secondary car door/shaft door coupling and an actuator, wherein the actuator executes an actuator movement which causes the movement of the element of the car door/shaft door coupling and a secondary movement, which is substantially equal to the movement, of a secondary element of the secondary car door/shaft door coupling. The two car door/shaft door couplings can thus be operated synchronously. The actuator can comprise a drive motor. It is advantageous that the device for coupling the car door with the shaft door can be operated by means of a single drive motor.

In a development of the door system of the elevator installation the door system comprises a door leaf, wherein the door leaf comprises a pendulating guide mount with at least two damping elements and a floating block mounted in the pendulating guide mount and coupled with the support element of the car door/shaft door coupling, wherein the floating block is spring loaded against abutments in horizontal direction parallel to the door leaf plane at both sides by a respective one of the damping elements and wherein at least one pendulating guide limiter of the pendulating guide mount prevents pendulating movement in directions not corresponding with the horizontal direction parallel to the door leaf plane. Thus, centering of the car door/shaft door coupling between coupling elements arranged at the door to be coupled can be achieved during the coupling process so that larger tolerances in the orientation of the car door/shaft door coupling with respect to the coupling elements facing it are possible.

DESCRIPTION OF THE DRAWINGS

The invention is explained in more detail in the following by way of figures, in which.

DETAILED DESCRIPTION

Figure 1:
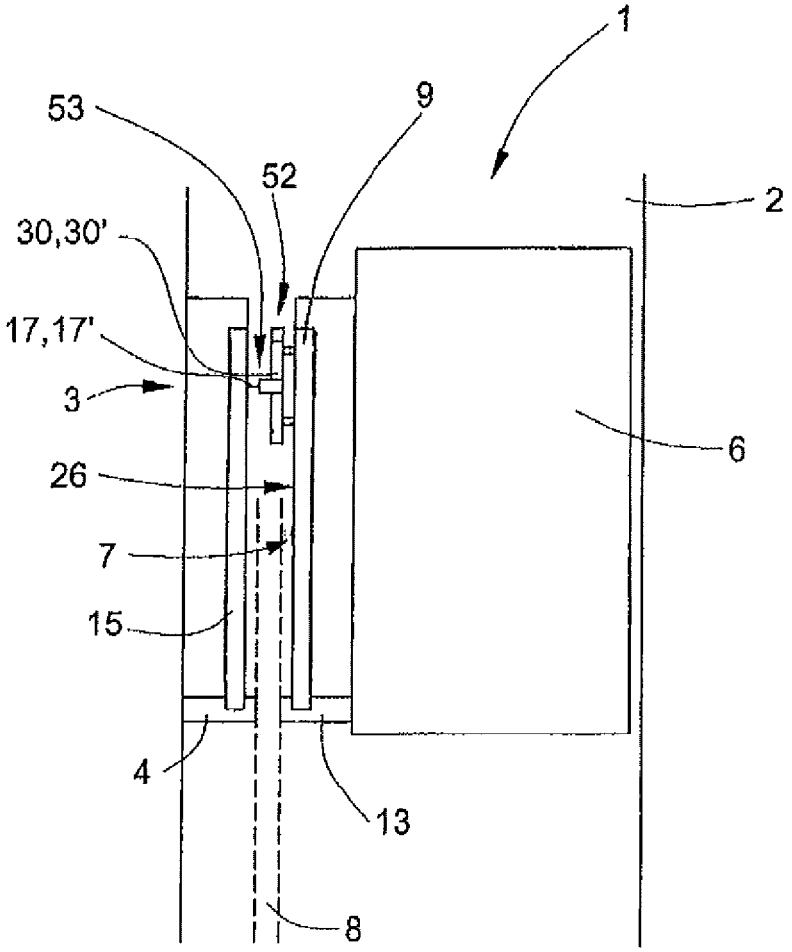
Fig. 1 (Prior Art)
FIG. 1 shows an elevator installation with a car door/shaft door coupling according to the prior art.

FIG. 1 shows an elevator installation 1. The elevator installation 1 comprises an elevator shaft 2 and an elevator car 6 movable in the elevator shaft 2. The elevator installation 1 comprises a door system 52. A shaft door 3 and a car door 7 of the elevator car 6 are part of this door system 52. The door system 52 comprises a car door/shaft door coupling 53 according to the prior art. The car door 7 has a car door threshold 13 and a car door leaf 9. The shaft door 3 has a shaft door threshold 4 and a shaft door leaf 15. The car door leaf 9 forms, parallel to the surface of its door leaf, a door leaf plane 26. The shaft door leaf 15 is arranged to be parallel to the car door leaf 9.

A spacing of the shaft door threshold 4 from the car door threshold 13 characterizes a gap having a width prescribed, inter alia, by legal regulations. The door system 52 comprises two coupling elements 17, 17', which in FIG. 1 are arranged one behind the other and located at the shaft door side. The car door/shaft door coupling 53 is arranged at the car door side and comprises two entrainer elements 30, 30'. The coupling elements 17, 17' are arranged within the gap 8. If the entrainer elements 30, 30' during travel of the elevator car 6 are disposed within the gap 8 it is possible for the entrainer elements 30, 30', for example, to contact the shaft door threshold 4 or the coupling elements 17, 17'.

Forms of embodiment of a car door/shaft door coupling 11, which can be part of a door system 12 for coupling a car door with a shaft door in an elevator installation, are shown in FIGS. 2 to 4 and 9. The door system 12 can be positioned in place of the door system 52 of FIG. 1, wherein coupling elements can be arranged similarly to FIG. 1. Parts of the car door/shaft door coupling 11 can be retracted at least partly out of a gap as indicated, for example, in FIG. 1. The car door/shaft door coupling 11 comprises a pivot lever 14, a movable element 18 and a support element 40. The pivot lever 14 is mounted on the support element 40 to be rotatable at an axis 16 of rotation. The support element 40 can be provided for the purpose of being part of a door leaf or being fastened to a door leaf. The movable element 18 is coupled with the pivot lever 14 at a bearing axis 20. An entrainer element 30 can be borne on the pivot lever 14 at an entrainer axis 28. The entrainer axis 28 is parallel to the rotational axis 16 of the support element 40 and can be spaced therefrom. A second entrainer element 30' can preferably be borne on the pivot lever 14 at a second entrainer axis 28', which is similarly parallel to the axis 16 of rotation. The axis 16 of rotation is preferably oriented perpendicularly to a door leaf plane 26, which can also be projected onto the support element 40 of the car door/shaft door coupling 11.

The movable element 18, driven by an actuator (not illustrated) which can be part of the door system 12, can execute a movement S oriented parallelly to the door leaf plane 26. In that case it does not matter whether the movement S is executed to be parallel to the door leaf plane 26 or whether only a directional component of this movement S is oriented parallelly to the door leaf plane 26. The movement S can also be executed to be perpendicular within a door system of an elevator installation. The coupling of the movable element 18 with the pivot lever 14 has the effect that the pivot lever 14 mounted at the support element 40 executes a rotational movement D.

The car door/shaft door coupling 11 (FIGS. 2 to 4) has a first slide surface 22 and a second slide surface 24, which are inclined relative to the door leaf plane 26 and can be arranged to complementary. By complementary arrangement of the slide surfaces 22, 24 it is meant that the slide surfaces 22, 24 can slide against one another or slide along one another. At the same time, the movement S has the effect that the first slide surface 22, which can face the movable element 18, slides on or along the second slide surface 24, which can face the support element 40, by means of a sliding movement G. Due to the inclination of the slide surfaces 22, 24 the pivot lever 14 therefore equally executes a horizontal movement H, which is performed perpendicularly to the door leaf plane 26. A spacing of the pivot lever 14 from the door leaf plane 26 is changed in correspondence with this horizontal movement H, i.e. the pivot lever 14 projects, due to the sliding movement G, into the gap between car door threshold and shaft door threshold. This means that the horizontal movement H and the rotational movement D are executed simultaneously.

Figure 2:
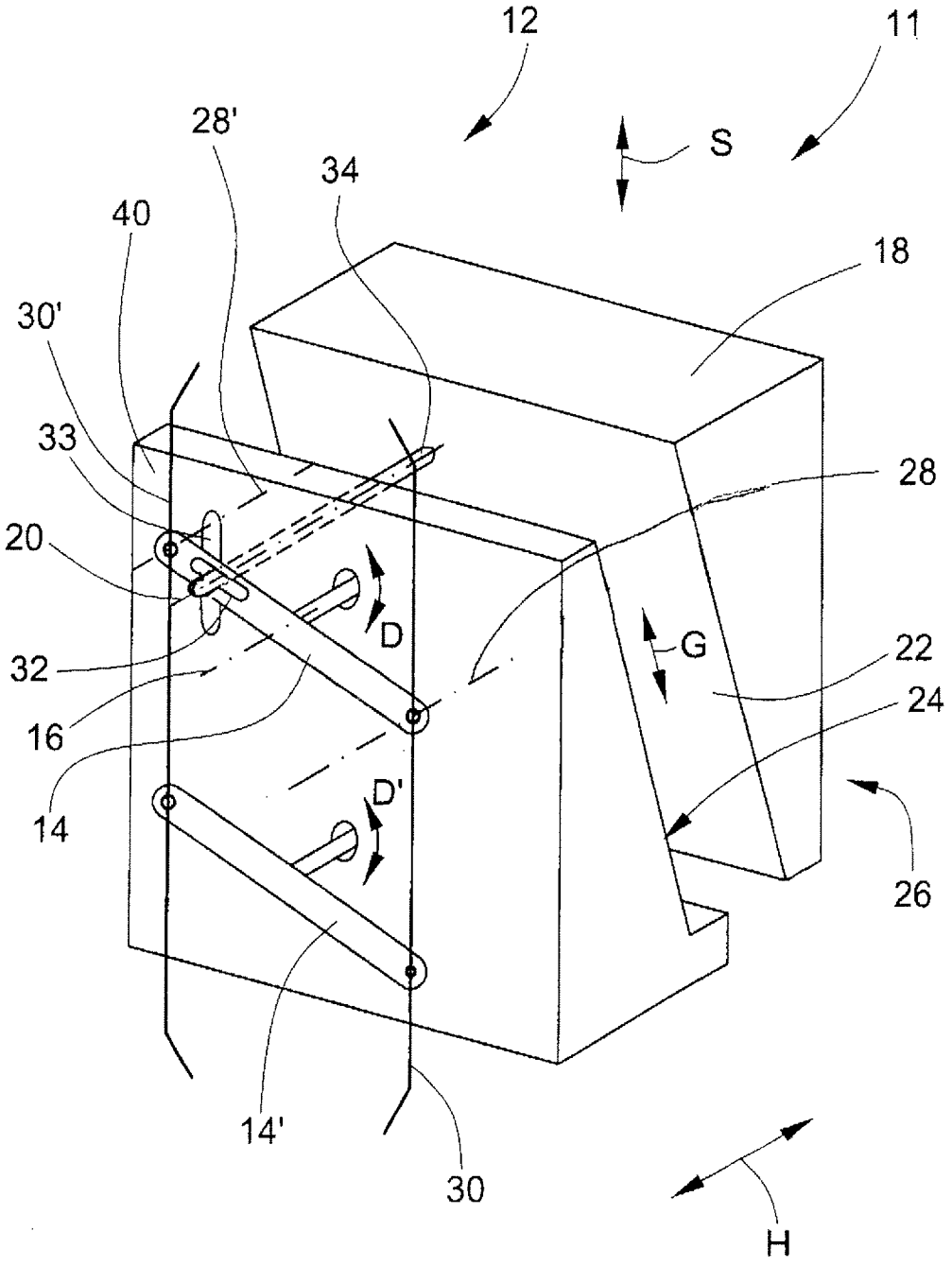
FIG. 2 shows a first variant of embodiment of the car door/shaft door coupling according to the invention in a perspective view.
Figure 3:
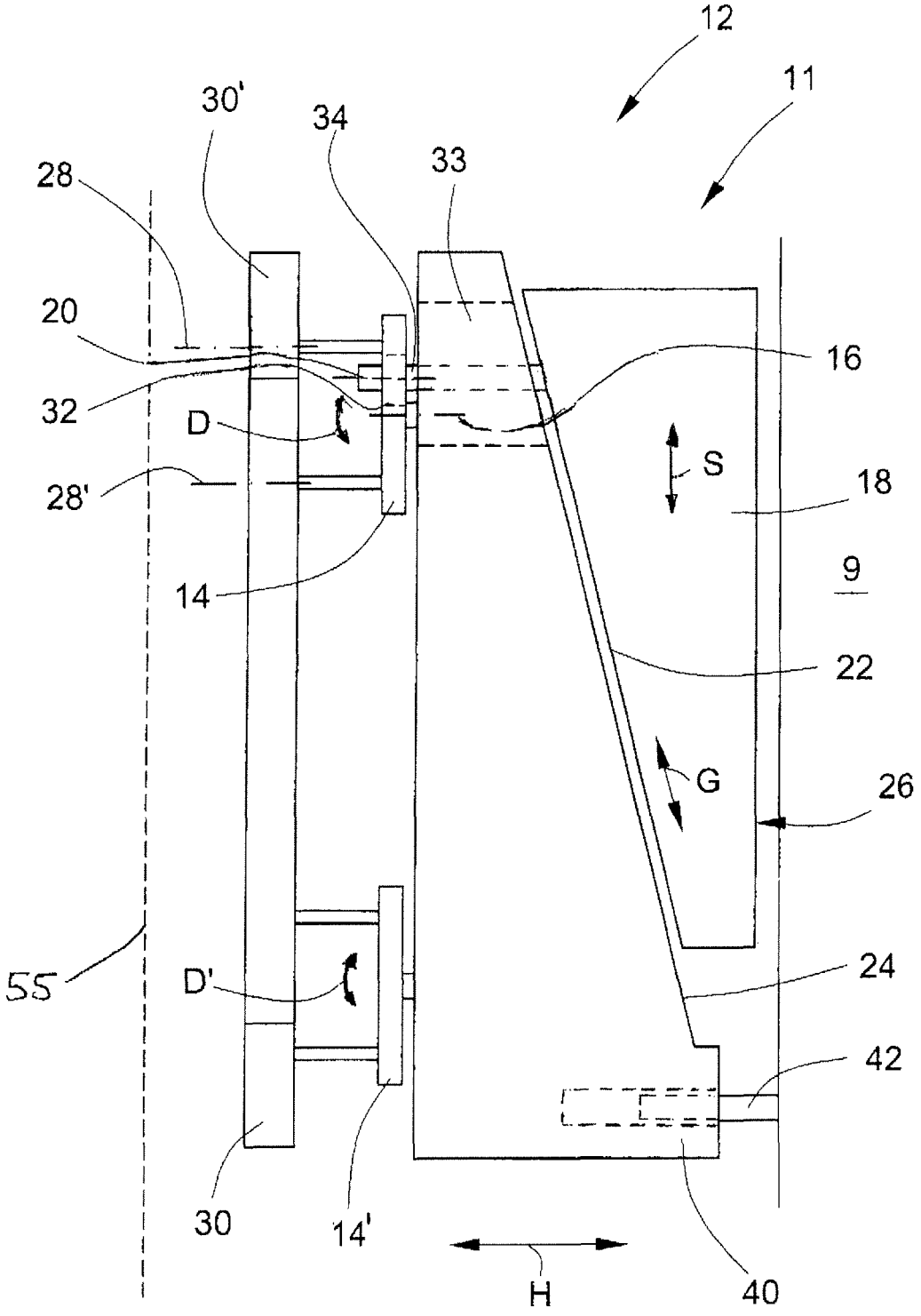
FIG. 3 shows a door system with the car door/shaft door coupling according to FIG. 2 in a side view.
Figure 4:
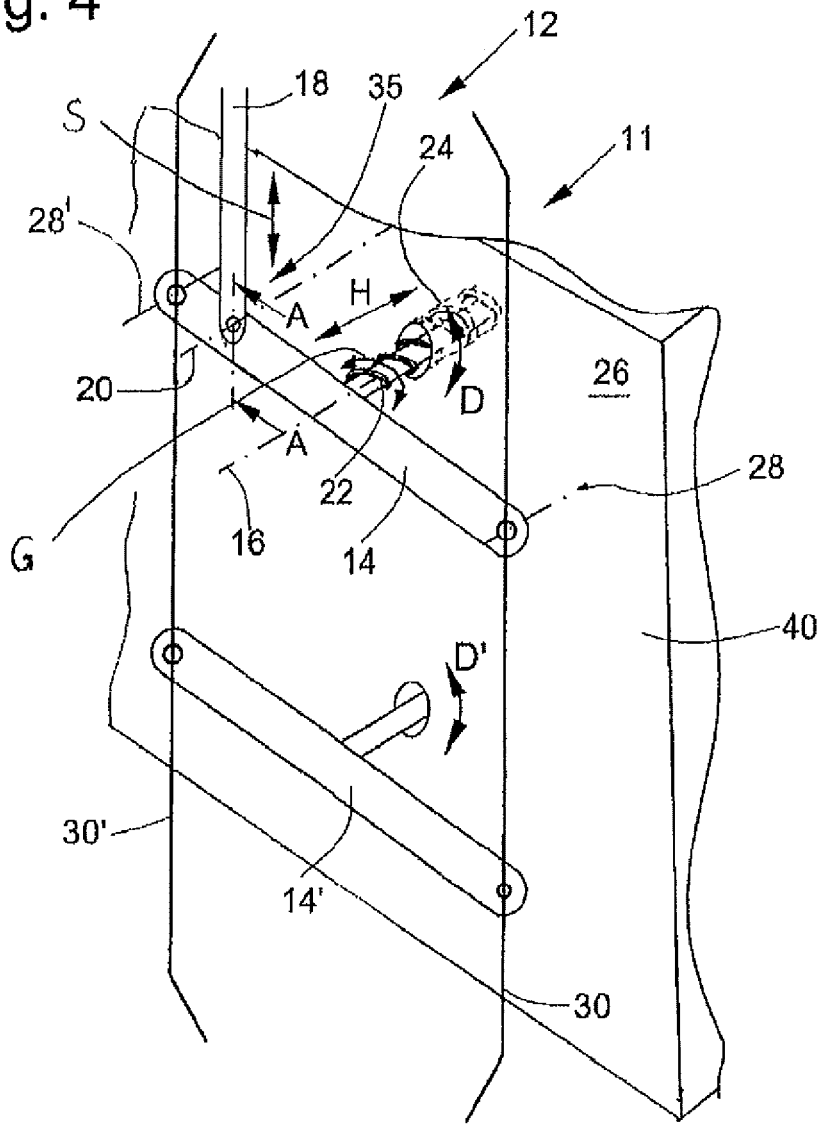
FIG. 4 shows a second variant of embodiment of the car door/shaft door coupling according to the invention.
Figure 9:
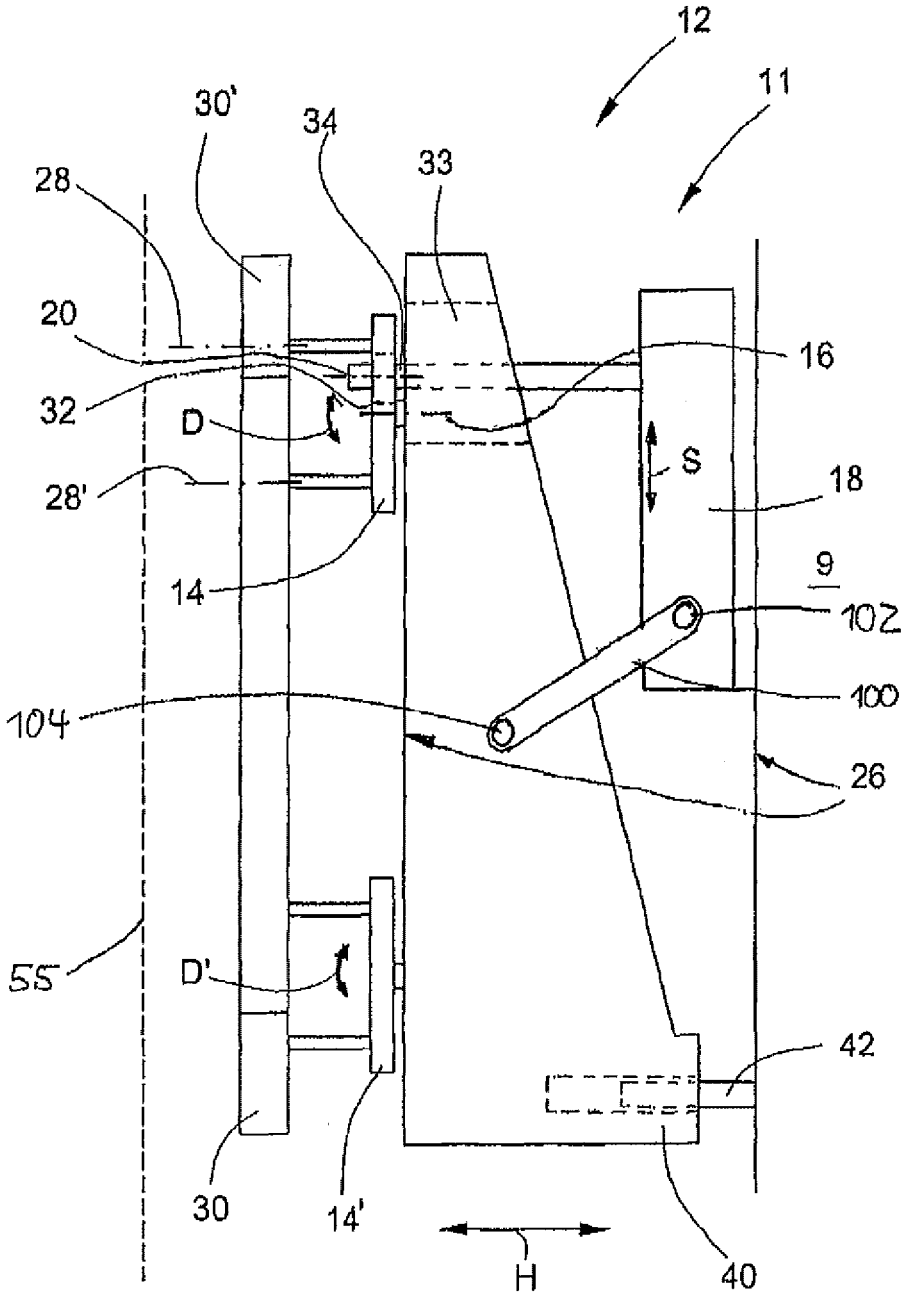
FIG. 9 shows a third variant of embodiment of the car door/shaft door coupling according to the invention.

The car door/shaft door coupling 11 shown in FIG. 9 has, instead of the slide surfaces 22, 24 shown in FIGS. 2 to 4, a changed movement transmission mechanism which couples the movable element 18 with the support element 40 and thus produces a horizontal movement H of the support element 40. The pivot lever 14 executes, just like the support element 40, the horizontal movement H.

With regard to the functionality of the car door/shaft door coupling 11 shown by way of example in FIGS. 2 to 4 and 9 it does not matter whether the horizontal movement H is executed perpendicularly to the door plane 26 or horizontally or whether only a directional component of this horizontal movement H is oriented perpendicularly to the door plane 26 or horizontally as long as in that case the functionality of the car door/shaft door coupling 11 is given. In addition to the fact that the pivot lever 14 protrudes, due to the rotational movement D, into the gap its rotational movement D serves the purpose that the entrainer elements 30, 30' coupled therewith are brought into a position in which they couple with the coupling elements of the coupling device. In a door system with such a car door/shaft door coupling 11 the rotational movement D thus produces a coupling of a car door with a shaft door.

The car door/shaft door coupling 11 can comprise a second pivot lever 14' on which the at least one entrainer element 30, 30' is mounted. The second pivot lever 14' is rotatably mounted on the support element 40 and, by virtue of the movements of the entrainer elements 30, 30', executes a passive rotational movement D'. The rotational movement D' of the second pivot lever 14' corresponds with the rotational movement D of the pivot lever 14. In that way, orientation of the at least one entrainer element 30, 30' in the elevator installation during coupling and decoupling processes can be maintained. The car door/shaft door coupling 11 is preferably arranged at the car door side, but can also be arranged at the shaft door side. Consequently, coupling elements of the door system 12 are arranged on the complementary side. The described sequence of movements S, D, H of the car door/shaft door coupling 11 can also be employed on door systems with different variants of embodiment of a car door/shaft door coupling according to the invention. In order that the movement S of the movable element 18 can be converted into the rotational movement D and the horizontal movement H of the pivot lever 14 the car door/shaft door coupling can have, instead of the mentioned slide surfaces 22, 24 (FIGS. 2 to 4) or the movement transmission lever 100 (FIG. 9), alternative movement transmission mechanisms.

FIGS. 2 and 3 show a first form of embodiment of the car door/shaft door coupling 11. The car door/shaft door coupling 11 comprises a schematically indicated guide device 42 (not illustrated in FIG. 2), on which the support element 40 is mounted. The guide device 42 makes the horizontal movement H of the support element 40 possible. The guide device 42 is provided for the purpose of being fixed to a door leaf. The guide device 42 can comprise, for example, a tension spring so that mutual contact of the two slide surfaces 22, 24 and thus the horizontal movement H of the support element 40 can be ensured at all times. However, the support element 40 and the pivot lever 14 do not execute a horizontally oriented movement relative to one another, i.e. the pivot lever 14 and the support element 40 are always at the same spacing. The first slide surface 22 is arranged at the movable element 18 and the second slide surface 24 at the support element 40. The movable element 18 has a pin 34. This pin 34 engages in a slot 32 of the pivot lever 14 in order to convert the movement S of the movable element 18 into a rotational movement D of the pivot lever 14. For realization of such a pin able to execute a movement relative to the support element 40 the support element 40 can be provided with a slot 33. Alternatively thereto the pin 34 can be coupled with the pivot lever 14, in which case the pin 34 goes past the support element 40.

The car door/shaft door coupling 11 of FIG. 3 is arranged at a car door leaf 9. A boundary 55, which is defined by a car door threshold, of a gap is illustrated and is explained in the description with respect to FIG. 1. Consequently, in accordance with this illustration the car door/shaft door coupling 11 does not project into this gap. A movement S of the movable element 18 with respect to the illustrated guide device 14 on the one hand produces a horizontal movement H of the support element 40 and thus of the at least one pivot lever 14, 14' along its axis 16 of rotation away from the car door leaf 9. The entrainer elements 30, 30' are thus moved into this gap beyond the boundary 55. On the other hand, such a movement S produces spreading of the entrainer elements 30, 30' due to the rotational movement D, which results from this movement S and is caused by the pin 34, of the pivot levers 14, 14'. A movement S of the movable element 18 in the opposite direction, thus away from the illustrated guide device 42, causes the corresponding opposite.

FIG. 4 shows a second form of embodiment of the car door/shaft door coupling 11. The movable element 18 is connected with the pivot lever 14 by means of a bearing 35. The first slide surface 22 is arranged at the pivot lever 14 and the slide surface 24 is arranged at the support element 40. The slide surfaces 22, 24 have the form of threaded surfaces which can be complementary.

The movement S, which according to FIG. 4 is directed downwardly, of the element 18 on the one hand produces the horizontal movement H of the at least one pivot lever 14, 14' along its axis 16 of rotation. In that case, the spacing of the at least one pivot lever 14, 14' from the illustrated door leaf plane 26 increases. Thus, the entrainer elements 30, 30' can be moved into the previously mentioned gap. On the other hand, such a movement S produces spreading of the entrainer elements 30, 30' due to the rotational movement D, which results from this movement S, of the pivot levers 14, 14'. Accordingly, the car door leaf 9 can be coupled with a shaft door leaf. A movement S, which is directed upwardly in accordance with FIG. 4, of the element 18 produces the corresponding opposite.

FIG. 9 shows a third form of embodiment of the car door/shaft door coupling 11. The car door/shaft door coupling 11 illustrated in FIG. 9 shows, by contrast to the car door/shaft door coupling 11 illustrated in FIG. 3, a changed movement transmission mechanism which couples the movable element 18 with the support element and thus produces the movement H of the support element 40. Consequently, the slide surfaces 22, 24 illustrated in FIG. 3 are replaced by a movement transmission lever 100. The movement transmission lever 100 comprises two lever bearings 102, 104. The movement transmission lever 100 is pivotably mounted on the movable element 18 at a first one of the lever bearings 102. The movement transmission lever 100 is pivotably mounted on the support element 40 at a second one of the lever bearings 104. The movement S of the movable element 18 has the effect, by means of a movement of the movement transmission lever 100, that the support element 40 and thus also the pivot lever 14 execute a horizontal movement H oriented perpendicularly to the door leaf plane 26. Instead of the sliding movement G illustrated in accordance with FIG. 3, the movement of the movement transmission lever 100 has the consequence that the support element 40, thus also the pivot lever 14, executes the horizontal movement H.

Figure 5:
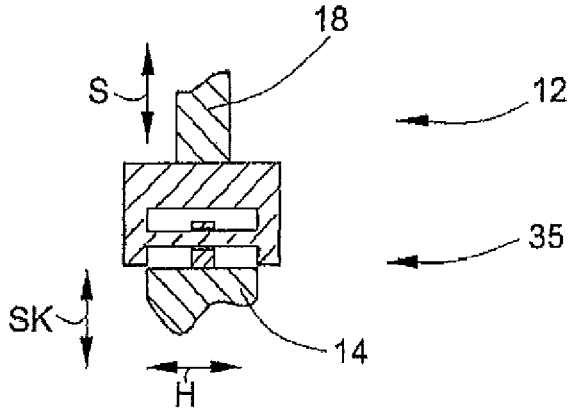
FIG. 5 shows a bearing for coupling an element with a pivot lever of the car door/shaft door coupling in a sectional illustration.

FIG. 5 shows a sectional illustration of a bearing 35 according to FIG. 4. The bearing 35 can be part of a door system 12. The bearing can comprise, for example, a part of a movable element 18, which can execute a movement S, and a part of a pivot lever 14. The pivot lever 14 itself is, according to FIGS. 2 to 4, rotatably mounted at an axis of rotation. The preferably vertically directed movement S has the effect that the part of the pivot lever 14 executes, due to its rotatable mounting, a movement of which the components are a vertically directed movement component SK and a horizontally directed movement component H.

Figure 6:
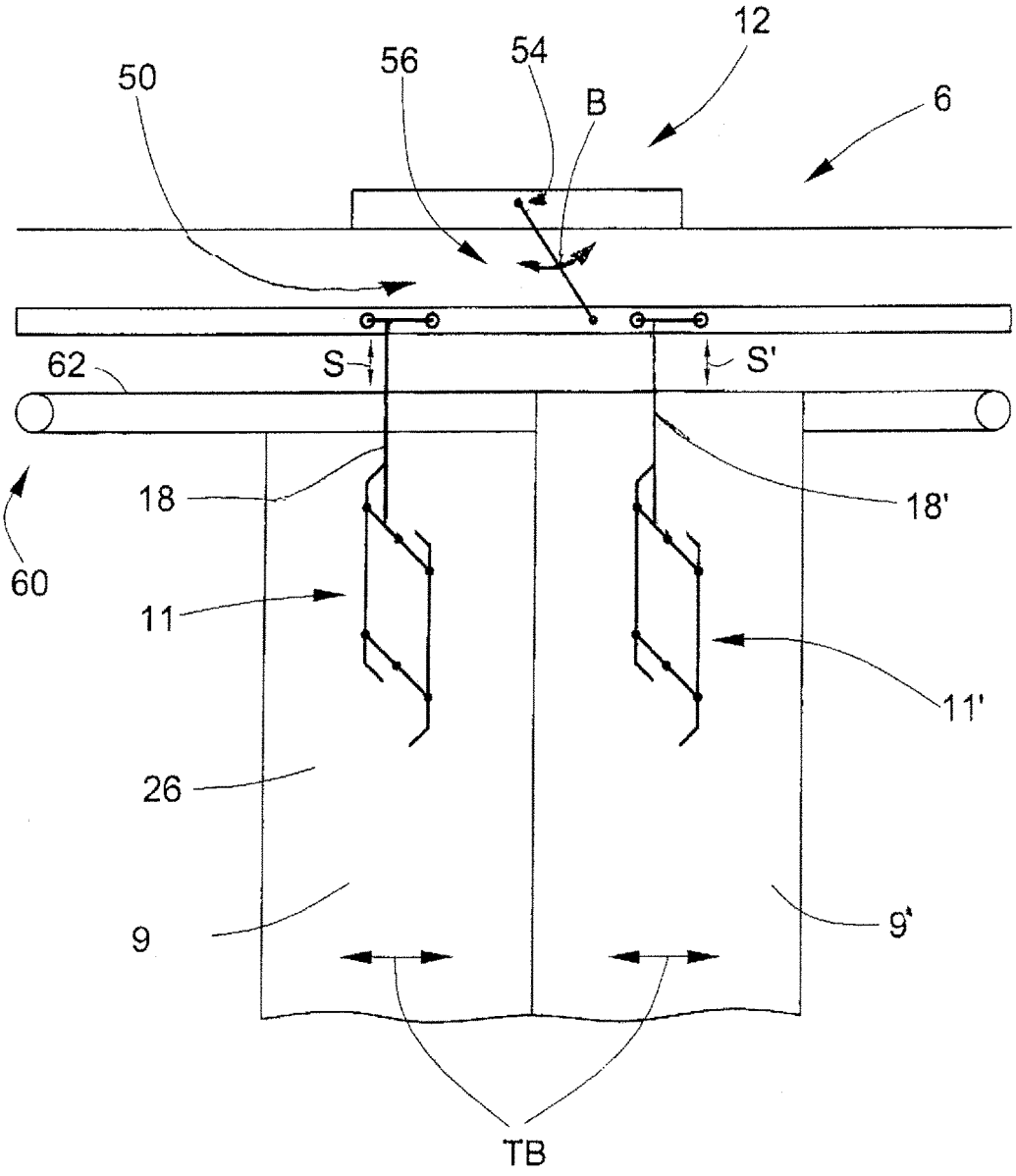
FIG. 6 shows a door system with two car door/shaft door couplings.

FIG. 6 shows a front view of an elevator car 6 with a door system 12. The door system 12 comprises a car door/shaft door coupling 11, a secondary car door/shaft door coupling 11', door leaves 9, 9' and an actuator 50. The car door/shaft door coupling 11 is arranged at a door leaf 9 of the elevator car 6 and the secondary car door/shaft door coupling 11' is arranged at a secondary door leaf 9'. The door leaves 9, 9' are so coupled to a drive element 62 of a door drive 60 that during operation of the door drive 60 they execute a door movement TB for opening/closing a door opening.

The actuator 50 comprises a drive motor 54 and a transmission linkage 56. The car door/shaft door coupling 11 comprises a movable element 18 and the secondary car door/shaft door coupling 11' comprises a secondary movable element 18'. The mode of functioning of the movable elements 18, 18' is explained in FIGS. 2 to 4. Operation of the drive motor 54 causes an actuator movement B of the actuator 50.

The movable elements 18, 18' of the car door/shaft door couplings 11, 11' are so mounted on the transmission linkage 56 that the movable element 18 executes a movement S parallel to a door leaf plane 26 and the secondary element 18' executes a secondary movement 8'. The secondary movement 8' is in that case substantially the same as the movement S. The movement S corresponds with the movement S which was explained in the description of FIGS. 2 to 4. The actuator movement B accordingly produces a coupling of a car door with a shaft door. Consequently, the coupling of the car door with the shaft door can be executed by the actuator movement B independently of the door opening movement TB.

Figure 7:
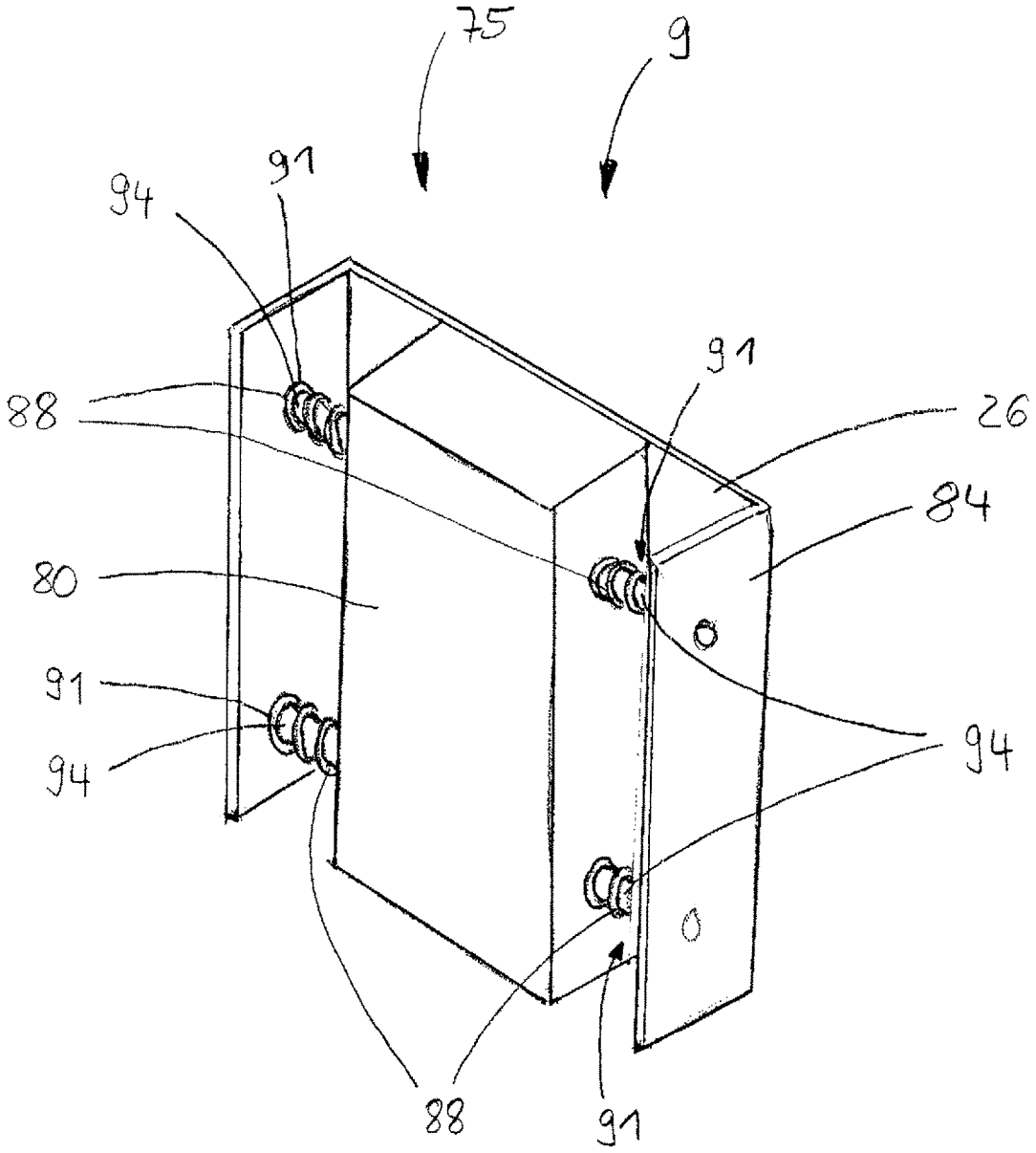
FIG. 7 shows a first variant of embodiment of a centering device for a door system.
Figure 8:
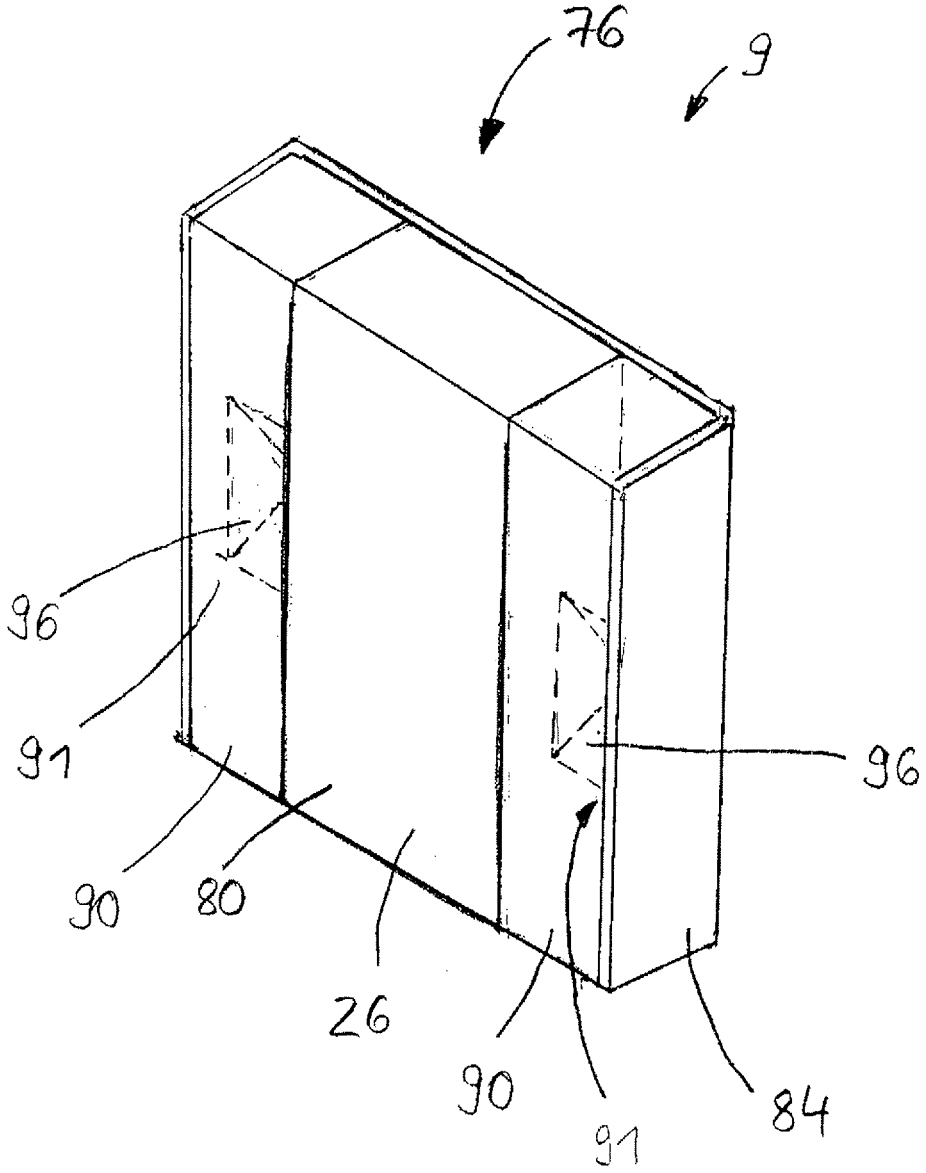
FIG. 8 shows a second variant of embodiment of a centering device for a door system.

FIGS. 7 and 8 show two variants of embodiment of a centering device 75, 76 as part of door panels 9. Such a centering device 75, 76 can, together with a car door/shaft door coupling according to the invention, be a component of a door system of an elevator installation. The centering device 75, 76 comprises a pendulating guide mount 84 and a floating block 80. The pendulating guide mount 84 comprises at least two damping elements 88, 90 and at least one pendulating guide limiter 94, 96. The pendulating guide mount 84 can be fixed to, for example, the door leaf of a door panel and therefore has a door leaf plane 26. The part of the car door/shaft door coupling 11 fastenable to the door panel 9 can be attached to the floating block 80. For example, this part can be the support element 40 of the variant of embodiment, which is described in FIG. 4, or the guide device 42 of the variant of embodiment, which is described in FIGS. 2 and 3, of the car door/shaft door coupling 11 according to the invention. The floating block 80 is mounted in the pendulating guide mount 84. A movement of the floating block 80 along pendulating guide limiters 94, 96, is limited by abutments 91 of the pendulating guide mount 84. In that case, the centering device 75, 76 can be so fixed to the door leaf of an elevator installation that the movement of the floating block 80 along the pendulating guide limiter runs in horizontal direction.

The pendulating guide mount 84, which is illustrated in FIG. 7, of the centering device 75 comprises four pins 94 as pendulating guide limiters, which preferably extend parallel to the door leaf plane 26. The floating block 80 has guide bores corresponding with the pins 94. In this way the floating block can be moved along the pins 94 parallel to the door leaf plane 26. Four damping elements are arranged in the form of springs 88, which surround the pins 84 longitudinally between the abutments 91 and the floating block 80. These springs 88 enable spring-loading of the floating block 80 between the abutments 91 and thus self-centering of the car door/shaft door coupling, which is fastenable to the floating block 80, during the coupling process between the coupling elements of a door system.

By contrast to the centering device 75 illustrated in FIG. 7, the pendulating guide mount 84, which is illustrated in FIG. 8, of the centering device 76 comprises two resilient blocks 90 as damping elements and a linear guide 96, preferably a dovetail guide, as pendulating guide limiter.

The floating block 80 is provided with a groove corresponding with the linear guide 96. By means of the linear guide 96, which preferably extends parallelly to the door leaf plane 26, the floating block 80 can be moved in the pendulating guide mount 84 between the abutments 91 parallelly to the door leaf plane 26. Arranged on either side of the floating block 80 and between the abutments 91 and the floating block 80 is a respective one of the resilient blocks 90. These resilient blocks 90 enable spring-loading of the floating block 80 between the abutments 91 and thus self-centering of the car door/shaft door coupling, which is fastenable to the floating block 80, between the coupling elements of a door system.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A car door/shaft door coupling comprising:

a pivot lever rotatably mounted on a support element for rotation about an axis of rotation, the support element being mounted on a door leaf, the door leaf having a door leaf plane; and a movable element coupled to the pivot lever wherein a movement of the movable element parallel to the door leaf plane causes the pivot lever to execute a rotational movement for coupling of a car door including the door leaf with a shaft door and simultaneously change a spacing of the pivot lever from the door leaf plane by horizontal movement transverse to the door leaf plane.

2. The car door/shaft door coupling according to claim 1 wherein the car door/shaft door coupling has a first slide surface and a second slide surface which surfaces are inclined relative to the door leaf plane whereby movement of the movable element parallel to the door leaf plane by the first slide surface sliding on the second slide surface at the same time causes a rotational movement and an horizontal movement of the pivot lever.

3. The car door/shaft door coupling according to claim 2 wherein the first slide surface is formed complementary with the second slide surface.

4. The car door/shaft door coupling according to claim 2 wherein the support element has the first slide surface and the pivot lever has the second slide surface formed as threaded surfaces.

5. The car door/shaft door coupling according to claim 1 wherein an entrainer element is mounted on the pivot lever at an entrainer axis spaced from and parallel to the axis of rotation.

6. The car door/shaft door coupling according to claim 5 wherein the entrainer element is a first entrainer element and the pivot lever is a first pivot lever, a second entrainer element is positioned parallel to and spaced from the first entrainer element, wherein the second entrainer element is mounted on a second pivot lever at another entrainer axis spaced from and parallel to the axis of rotation.

7. The car door/shaft door coupling according to claim 6 wherein the first and second pivot levers are rotatably mounted on the support element.

8. The car door/shaft door coupling according to claim 1 wherein the movable element is coupled with the pivot lever at a bearing axis parallel to and spaced from the axis of rotation.

9. The car door/shaft door coupling according to claim 1 wherein the pivot lever is connected with the movable element by a bearing.

10. The car door/shaft door coupling according to claim 1 wherein the support element is one of integral to the door leaf and fastened to the door leaf.

11. The car door/shaft door coupling according to claim 1 including a guide device at which the support element is guided perpendicularly to the door leaf plane, the guide device being fastened to the door leaf.

12. The car door/shaft door coupling according to claim 11 wherein the pivot lever has a slot and the movable element has a pin, wherein the pin engages in the slot.

13. A door system of an elevator installation including the car door/shaft door coupling according to claim 1.

14. The door system according to claim 13 wherein the door leaf comprises:

a pendulating guide mount with at least two damping elements and at least one pendulating guide limiter; and a floating block mounted in the pendulating guide mount and coupled with the support element, wherein the floating block is spring loaded against abutments in a horizontal direction parallel to the door leaf plane at both sides by a respective one of the damping elements and wherein the pendulating guide limiter prevents pendulating movement in directions not corresponding with the horizontal direction parallel to the door leaf plane.

15. The door system according to claim 13 including a secondary car door/shaft door coupling and an actuator, wherein the actuator executes an actuator movement causing the movement of the movable element of the car door/shaft door coupling and a secondary movement that is substantially equal to a movement of a secondary movable element of the secondary car door/shaft door coupling.

16. The door system according to claim 15 wherein the actuator is a drive motor.

* * * * *